US008336625B2

(12) United States Patent
Mullen et al.

(10) Patent No.: US 8,336,625 B2
(45) Date of Patent: Dec. 25, 2012

(54) FRACTURING/GRAVEL PACKING TOOL WITH VARIABLE DIRECTION AND EXPOSURE EXIT PORTS

(75) Inventors: Bryon D. Mullen, Carrollton, TX (US); Colby M. Ross, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 2071 days.

(21) Appl. No.: 10/980,544

(22) Filed: Nov. 3, 2004

(65) Prior Publication Data

US 2006/0090900 A1 May 4, 2006

(51) Int. Cl.
*E21B 43/25* (2006.01)

(52) U.S. Cl. ..... 166/305.1; 166/381

(58) Field of Classification Search ..... 166/278, 166/305.1, 376, 381, 169
See application file for complete search history.

(56) References Cited

U.S. PATENT DOCUMENTS

| | | | | |
|---|---|---|---|---|
| 1,530,221 | A * | 3/1925 | Uren | 166/278 |
| 3,692,114 | A * | 9/1972 | Murphey et al. | 166/278 |
| 4,722,392 | A | 2/1988 | Proctor et al. | |
| 4,840,229 | A | 6/1989 | Proctor et al. | |
| 4,919,204 | A * | 4/1990 | Baker et al. | 166/223 |
| 5,636,691 | A | 6/1997 | Hendrickson et al. | |
| 5,901,789 | A * | 5/1999 | Donnelly et al. | 166/381 |
| 5,921,318 | A | 7/1999 | Ross | |
| 5,964,296 | A | 10/1999 | Ross | |
| 6,125,933 | A | 10/2000 | Ross | |
| 6,367,552 | B1 | 4/2002 | Scott et al. | |
| 6,491,097 | B1 * | 12/2002 | Oneal et al. | 166/278 |
| 6,540,025 | B2 | 4/2003 | Scott et al. | |
| 2003/0047311 | A1 * | 3/2003 | Echols et al. | 166/278 |
| 2004/0060698 | A1 * | 4/2004 | Ravensbergen et al. | 166/278 |

OTHER PUBLICATIONS

Halliburton presentation, "Weight Down Collets", undated.

* cited by examiner

*Primary Examiner* — Daniel P Stephenson
(74) *Attorney, Agent, or Firm* — Smith IP Services, P.C.

(57) ABSTRACT

A fracturing/gravel packing tool with variable direction and exposure exit ports. A system for delivering an erosive flow into a subterranean well includes a port displacing in the well while the erosive flow passes through the port. Various displacement devices may be used in the system to displace the port.

52 Claims, 8 Drawing Sheets

FRACTURING/GRAVEL PACKING TOOL WITH VARIABLE DIRECTION AND EXPOSURE EXIT PORTS

BACKGROUND

The present invention relates generally to equipment utilized and operations performed in conjunction with a subterranean well and, in an embodiment described herein, more particularly provides a fracturing/gravel packing tool with variable direction and exposure exit ports.

In situations in which an erosive flow is delivered into a well (such as in fracturing and/or gravel packing operations in which an erosive proppant or gravel slurry is flowed into the well), impingement of the flow on certain equipment, structures, etc. downhole can be very detrimental. For example, erosive impingement of the flow on the equipment and other structures such as casing can destroy the structures, cause damage to the well, require costly and time-consuming remediation operations, etc.

Past attempts to reduce or eliminate erosive damage to downhole structures have typically focused on increasing the resistance of the structures to erosion. For example, a structure might be lined with an erosion resistant material, such as tungsten carbide, or protected with a sacrificial material, in order to reduce or eliminate erosion of the structure.

It is known that the greatest erosion occurs where the erosive flow impinges on the structure after the flow passes through an exit port, and when a change in direction of the flow is a result of the flow impinging on the structure. Such exit ports are found, for example, in crossover tools used in fracturing and/or gravel packing operations.

Past methods of reducing or eliminating the erosion caused by this impingement have not been entirely satisfactory. Thus, it may be seen that a need exists for improved methods and systems for delivering an erosive flow into a well.

SUMMARY

In carrying out the principles of the present invention, in accordance with one of multiple embodiments described below, a system and method are provided which displace the exit port while the erosive flow is passing through the port. In this manner, displacement of the port displaces an erosive impingement of the erosive flow on a tubular structure external to the port.

In one aspect of the invention, a method of delivering an erosive flow into a subterranean well is provided. The method includes the steps of: passing the erosive flow through a port in the well; and displacing the port while the erosive flow passes through the port.

In another aspect of the invention, a system for delivering an erosive flow into a subterranean well is provided. The system includes a displacement device which displaces a port in the well while the erosive flow passes through the port.

In a further aspect of the invention, another system is provided which includes a port displacing in the well while an erosive flow passes through the port. Various displacement devices may be used to displace the port, including but not limited to ratchet mechanisms, hydraulic metering devices, releasing devices, electric and hydraulic motors, hydraulic actuators, electromagnetic actuators, etc.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
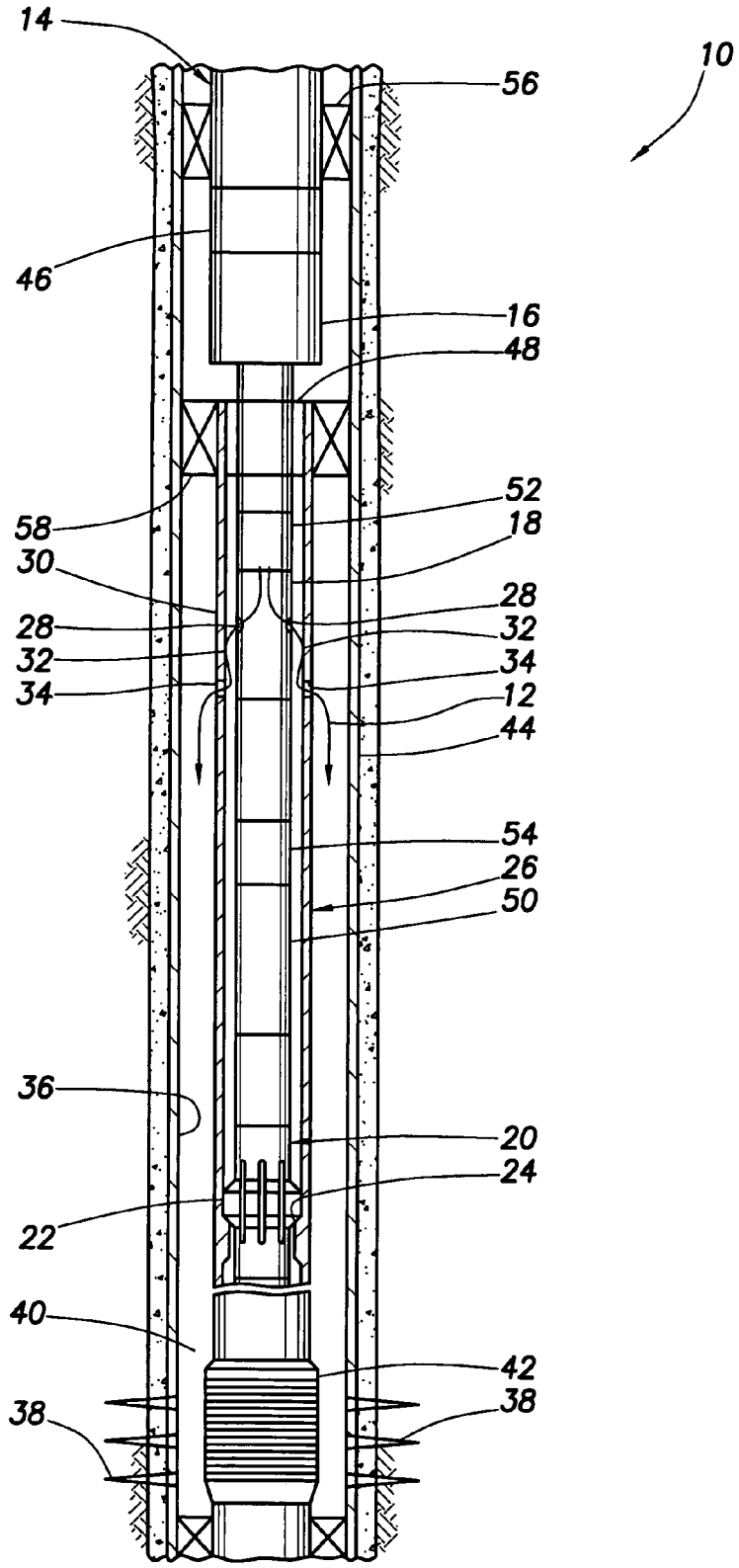
FIG. 1 is a schematic partially cross-sectional view of a fracturing/gravel packing system embodying principles of the present invention.

Representatively illustrated in FIG. 1 is a system 10 and associated method which embody principles of the present invention. In the following description of the system 10 and other apparatus and methods described herein, directional terms, such as "above", "below", "upper", "lower", etc., are used for convenience in referring to the accompanying drawings.

Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, an erosive flow 12 is delivered into a well by pumping it through a tubular string 14 positioned in the well. The tubular string 14 includes a service tool 16, a crossover tool 18 and an anchoring device 20. These components of the tubular string 14 are, for the most part, of conventional design and are well known to those skilled in the art of fracturing and gravel packing operations.

The anchoring device 20 is shown as being of the type known as a weight-down collet, which includes a collet assembly 22 for engagement with a reduced inner diameter shoulder or profile 24 formed in an outer tubular assembly 26 in which the tubular string 14 is received. The profile 24 is generally formed in a component of the assembly 26 known to those skilled in the art as an indicator collar. Use of the collet assembly 22 and profile 24 enables accurate positioning of the tubular string 14 in the assembly 26 during delivery of the erosive flow 12 into the well. Multiple profiles may be used if multiple zones are to be treated, such as described in U.S. Pat. No. 5,921,318, the entire disclosure of which is incorporated herein by this reference.

Engagement of the collet assembly 22 with the profile 24 also allows a compressive force to be applied to the tubular string 14 (for example, by slacking off on the tubular string at the surface) while the erosive flow 12 is being pumped through the tubular string, which helps to prevent undesirable movement of the tubular string in the assembly 26. An acceptable weight-down collet assembly for use in the system 10 is the ShurMAC™ Multi-Acting Collet available from Halliburton Energy Services, Inc. of Houston, Tex.

However, it may be desirable in some situations (such as when operations are performed from a floating vessel) to apply a tensile force to the tubular string 14 while the erosive flow 12 is being pumped through the tubular string. This may be accomplished by using a weight-up collet assembly in the anchoring device 20, such as that described in U.S. Pat. No. 4,840,229, the entire disclosure of which is incorporated herein by this reference. Note that it is not necessary for the anchoring device 20 to include any collets, since the anchoring device could include other types of locking mechanisms, such as a spring loaded key or another force limited locking mechanism, etc.

The crossover tool 18 includes exit ports 28 for discharging the erosive flow 12 from the interior of the tubular string 14. After the erosive flow 12 passes through the ports 28, it impinges on the interior of a tubular structure 30 of the assembly 26 at locations 32 external to the ports. In conventional systems, these impingement locations 32 would experience the most erosive damage due to the flow 12.

The assembly 26 also has exit ports 34 through which the flow 12 passes into a wellbore 36 of the well external to the assembly. In conventional practice, the ports 34 are typically closed by a closing sleeve (not shown) after the fracturing/gravel packing operation.

Proppant or gravel in the flow 12 may enter perforations 38 and accumulate in an annulus 40 between the assembly 26 and the wellbore 36. A fluid portion of the flow 12 may enter one or more screens 42 for return circulation to the surface.

When the flow 12 exits the ports 34 it may impinge on an interior of casing, liner, or another type of tubular structure 44 external to the ports, similar to the manner in which the flow impinges on the interior of the tubular structure 30. Thus, there may be multiple structures and different types of structures which may be eroded by the flow 12 as it is delivered into the well, and the principles of the invention may be used to protect each of these structures from this erosion.

Specifically, one beneficial feature of the present invention is that it displaces the exit ports 28 while the erosive flow 12 passes through the ports, thereby displacing the erosive impingement locations 32 on the structure 30. By displacing the impingement locations 32, erosion of the structure 30 is effectively spread over a larger surface area of the interior of the structure, reducing the possibility that the structure will be eroded through or severely weakened.

To displace the ports 28, various displacement devices 46, 48, 50 may be incorporated into the tubular string 14. The displacement devices 46, 48, 50 may be used to provide longitudinal, rotational, combined longitudinal and rotational (such as helical), or other types of displacements of the ports 28.

Although three displacement devices 46, 48, 50 are depicted in FIG. 1, these are preferably alternatives and in practice only one displacement device would preferably be used. However, it should be clearly understood that any number, any combination and any types of displacement devices may be used in keeping with the principles of the invention.

Where the displacement is at least partially rotational, one or more swivel subs 52, 54 may be interconnected in the tubular string 14 to allow for rotation. For example, if the tubular string 14 is secured to the assembly 26 by the anchoring device 20, and it is desired to rotate the exit ports 28 within the assembly, then the swivel 54 may be interconnected between the crossover tool 18 and the anchoring device.

Alternatively, it may be desired to secure the tubular string 14 in the well using an anchoring device 56, such as a packer, set above the assembly 26, in which case the anchoring device 20 may not be used at all. In this situation, the swivel 52 would permit rotation of the crossover tool 18 relative to the anchoring device 56.

The displacement device 46 depicted in FIG. 1 demonstrates that a displacement device may be positioned above the service tool 16, above the assembly 26 and/or above the crossover tool 18. Preferably, the displacement device 46 is interconnected in the tubular string 14 between the anchoring device 56 and the crossover tool 18, so that the crossover tool can be displaced relative to the anchoring device.

The displacement device 50 depicted in FIG. 1 demonstrates that a displacement device may be positioned below the service tool 16, below the crossover tool 18 and/or within the assembly 26. Preferably, the displacement device 50 is interconnected in the tubular string 14 between the anchoring device 20 and the crossover tool 18, so that the crossover tool can be displaced relative to the anchoring device.

The displacement device 48 depicted in FIG. 1 demonstrates that a displacement device may be used at an interface or interconnection between the tubular string 14 and the assembly 26. In the illustrated system 10, the displacement device 48 is positioned at an interface between the service tool 16 and a packer 58 of the assembly 26.

Preferably, the service tool 16 can be used to set the packer 58, and the displacement device 48 can then be used to displace the service tool (and the remainder of the tubular string 14) relative to the packer (and the remainder of the assembly 26). In this situation, the packer 58 is used as an anchoring device to secure the tubular string 14 in the wellbore 36.

As discussed above, tension or compression may exist in the tubular string 14 while the flow 12 is delivered into the wellbore 36. This tension or compression may be used to displace the ports 28.

For example, if the anchoring device 20 is used to secure the tubular string 14, then the displacement device 50 may elongate and/or rotate in response to tension in the tubular string, thereby displacing the ports 28. Similarly, if a compressive force exists in the tubular string 14 during delivery of the flow 12 into the wellbore 36, the displacement device 50 may compress and/or rotate to displace the ports 28.

Elongation or compression of the displacement device 50 would, of course, elongate or compress the tubular string 14 between the crossover tool 18 and the anchoring device 20. A hydraulic metering device or other mechanism may be used to regulate the rate of the elongation or compression as desired.

Hydraulic metering could also be used in the displacement device 48. For example, after the service tool 16 is used to set the packer 58, set-down weight or an upward pull may be applied to the tubular string 14, and hydraulic metering in the displacement device 48 could be used to regulate the rate at which the tubular string displaces relative to the assembly 26 in response to the compressive or tensile force in the tubular string above the service tool.

The displacement devices 46, 48, 50 could alternatively, or in addition, include any type of actuator. For example, an electric motor, hydraulic motor, electromagnetic actuator, hydraulic actuator, etc., or any combination of actuators may be used.

The displacement devices 46, 48, 50 do not necessarily include an actuator. Instead, the displacement devices 46, 48, 50 could include other means for producing displacement, such as releasing devices, ratchet mechanisms, etc.

The displacement devices 46, 48, 50 may be incorporated into or combined with other components of the system 10. For example, the displacement device 50 could be part of the anchoring device 20, the displacement device 48 may be incorporated into the service tool 16 and/or packer 58, and the displacement device 46 may be combined with the anchoring device 56.

Several different displacement device configurations which may be used for the displacement devices 46, 48, 50 in the system 10 are described in more detail below. However, it should be clearly understood that these are given merely as examples of the wide variety of displacement devices which could be used in the invention, and the invention is therefore not to be taken as being limited to the configurations or other details described below.

Figure 2:
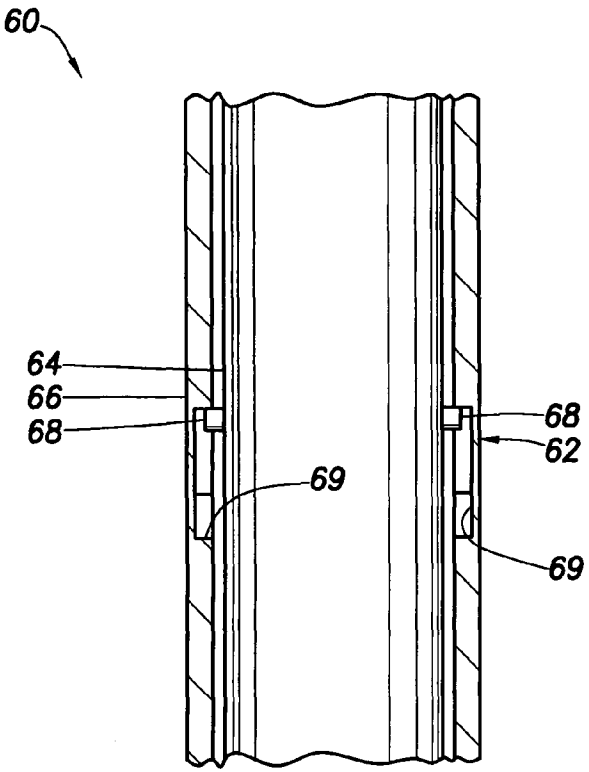
FIG. 2 is an enlarged scale schematic partially cross-sectional view of a first displacement device usable in the system of FIG. 1 and embodying principles of the invention.

Referring additionally now to FIG. 2, a displacement device 60 which may be used in the system 10 is representatively illustrated. The displacement device 60 includes a ratchet mechanism 62 which controls displacement between an inner tubular structure 64 and an outer tubular structure 66.

Figure 3:
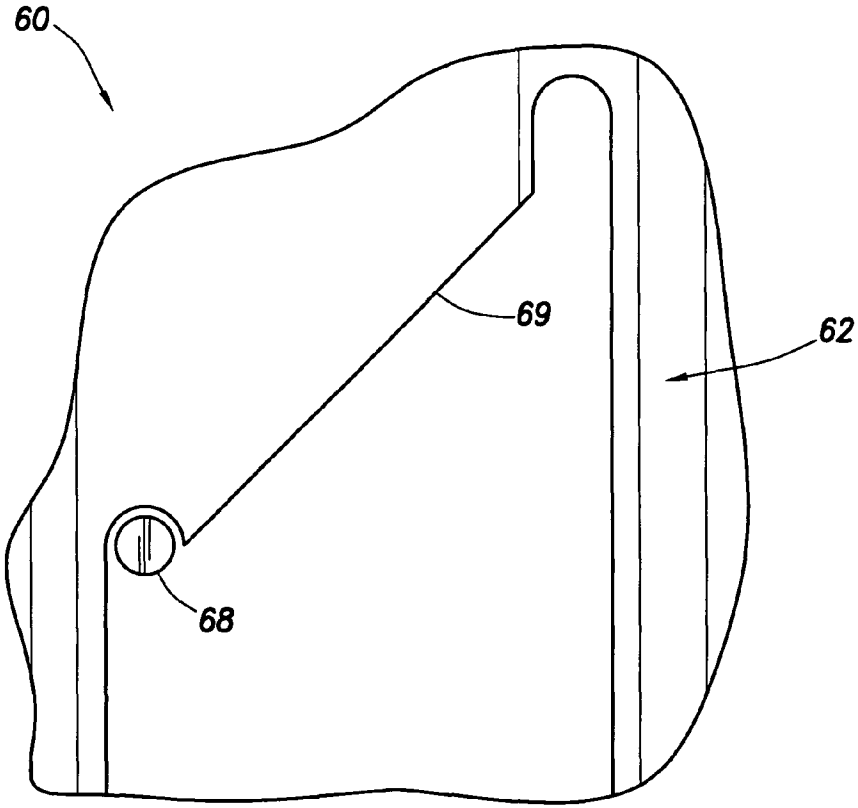
FIG. 3 is a further enlarged scale plan view of a ratchet mechanism in the device of FIG. 2.

As depicted in FIG. 2, the ratchet mechanism 62 is of the type which includes lugs 68 engaged in J-slot profiles 69. In FIG. 3, an enlarged scale "unrolled" view of one set of the lugs 68 and profiles 69 is illustrated.

In FIG. 2, the lugs 68 are shown engaged in an upper position in the profiles 69, whereas in FIG. 3, the lug is shown engaged in a lower position in the profile. The lugs 68 are also rotated relative to the profiles 69 in displacing between the position shown in FIG. 2 and the position shown in FIG. 3.

Thus, both longitudinal and rotational relative displacement may be provided between the inner and outer tubular structures 64, 66 using the displacement device 60. As depicted in FIGS. 2 & 3, upward displacement of the inner tubular structure 64 relative to the outer tubular structure 66 is used to engage the lug 68 in the upper and lower positions in the profile 69.

However, it will be appreciated that the ratchet mechanism 62 could easily be configured so that downward displacement of the inner tubular structure relative to the outer tubular structure is used to engage the lug in different longitudinal and/or rotational positions in the profile, such as by vertically reversing the profile, etc. Any configuration of the ratchet mechanism 62 may be used in keeping with the principles of the invention.

When used in the system 10, the displacement device 60 may be used to elongate or compress the tubular string 14, and/or to rotate one portion of the tubular string relative to another portion of the tubular string. For example, if the displacement device 60 is used for the device 50 depicted in FIG. 1, then engagement of the lug 68 in the various positions of the profile 69 may be used to longitudinally and/or rotationally displace the crossover tool 18 relative to the anchoring device 20.

The inner tubular structure 64 could be attached to the upper portion of the tubular string 14 (above the displacement device 60), and the outer tubular structure 66 could be attached to the lower portion of the tubular string (below the displacement device), or vice-versa. In that case, the displacement device 60 would be a longitudinally telescoping component of the tubular string 14.

Alternatively, the inner tubular structure 64 could be interconnected as a part of the tubular string 14 and the outer tubular structure 66 could be incorporated into the assembly 26, such as part of the packer 58. In that case the displacement device 60 could be used for the device 48 at the interface between the service tool 16 and the packer 58 as depicted in FIG. 1.

Another alternative would be to use the displacement device 60 for the device 46 shown in FIG. 1. In that case, the displacement device 60 could be a longitudinally telescoping component of the tubular string 14, or it could be incorporated into an interface between the tubular string and the anchoring device 56.

Yet another alternative would be to incorporate the displacement device 60 into the anchoring device 20. For example, the collet assembly 22 could be shifted to different longitudinal positions relative to the remainder of the tubular string 14 using the ratchet mechanism 62, thereby causing the tubular string (including the crossover tool 18) to be secured in different longitudinal positions relative to the assembly 26.

Thus, it will be readily appreciated that the displacement device 60 may be effectively incorporated into the system 10 in various different locations and positions, and may be combined with various other components of the system, in keeping with the principles of the invention. Locations, positions, combinations and configurations of the displacement device 60 other than those described above may also be used if desired.

In the following descriptions of other embodiments of displacement devices, it is to be understood these other embodiments may be used for any of the displacement devices 46, 48, 50 of the system 10, and in various positions, combinations and configurations, including those described above and other than those described above, in keeping with the principles of the invention.

Figure 4:
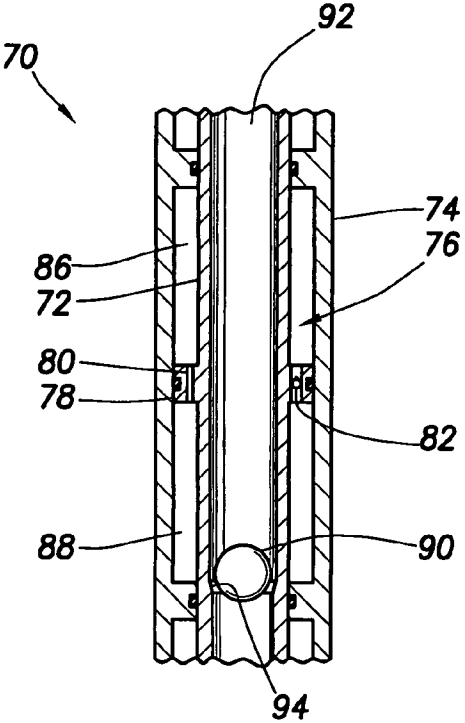
FIG. 4 is a schematic partially cross-sectional view of a second displacement device usable in the system of FIG. 1 and embodying principles of the invention.

Referring additionally now to FIG. 4, another displacement device 70 is representatively illustrated. The displacement device 70 includes an inner tubular structure 72 and an outer tubular structure 74. Relative longitudinal displacement between the inner and outer tubular structures 72, 74 is regulated by means of a hydraulic metering device 76.

The hydraulic metering device 76 includes a piston 78, an orifice or flow restrictor 80 and a check valve 82. The piston 78 is received in a bore 84, so that the piston divides two fluid chambers 86, 88.

In order for the inner tubular structure 72 to displace longitudinally relative to the outer tubular structure 74, fluid must flow from one of the chambers 86, 88 to the other chamber through either the flow restrictor 80 or the check valve 82. When the fluid flows through the flow restrictor 80 (i.e., when the inner tubular structure 72 displaces downward relative to the outer tubular structure 74 as depicted in FIG. 4), the displacement is slowed due to resistance to the flow through the flow restrictor.

However, when the fluid flows through the check valve 82 (i.e., when the inner tubular structure 72 displaces upward relative to the outer tubular structure 74 as depicted in FIG. 4), the displacement is relatively unimpeded due to a much larger flow area through the check valve. In this manner, the displacement device 70 may be conveniently "recocked" or prepared for subsequent use after previous downward displacement of the inner tubular structure.

It is not necessary for only downward displacement of the inner tubular structure 72 relative to the outer tubular structure 74 to be slowed due to fluid flow resistance. For example, if the check valve 82 is not used, then upward displacement of the inner tubular structure 72 relative to the outer tubular structure 74 can also be slowed due to resistance to the fluid flow through the flow restrictor 80. This may be desirable if the inner tubular structure 74 is to be displaced upward, thereby displacing the ports 28, during delivery of the flow 12 into the wellbore 36.

To displace the inner tubular structure 72 downward relative to the outer tubular structure 74, pressure may be applied to the displacement device 70. For example, a ball or other type of plug 90 may be installed in an inner flow passage 92 of the device 70 and sealingly engaged with a seat 94 to seal off the passage, so that pressure applied to the passage above the plug will bias the inner tubular structure 72 downward.

Alternatively, the device 70 may be interconnected in a tubular string (such as the tubular string 14 in the system 10) so that tension or compression in the tubular string will operate to elongate or compress the device. The device 70 may be easily configured to regulate displacement by flowing fluid through the flow restrictor 80 in response to either tension or compression in the tubular string, and to provide relatively unrestricted displacement by flowing fluid through the check valve 82 in response to either tension or compression in the tubular string.

Figure 5:
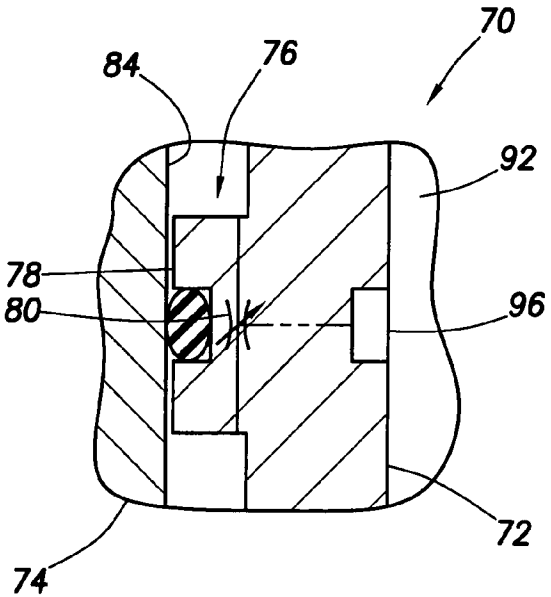
FIG. 5 is an enlarged scale schematic cross-sectional view of an alternate configuration of the device of FIG. 4.

Referring additionally now to FIG. 5, an alternate configuration of the device 70 is representatively illustrated. In this configuration, the flow restrictor 80 is shown schematically as a variable flow restrictor, so that resistance to flow through the flow restrictor may be changed when desired.

A sensor 96 may be used to detect a parameter of the erosive flow 12 in the passage 92. For example, pressure, density, flow rate or another parameter or combination of parameters of the erosive flow 12 may be detected by the sensor 96 and used to adjust the flow restrictor 80.

The flow restrictor 80 may be adjusted in response to an alteration in the parameter(s) sensed by the sensor 96. For example, a change in density of the erosive flow 12 as indicated by the sensor 96 may be used to adjust the flow restrictor 80 to increasingly or decreasingly restrict flow therethrough.

Thus, the manner in which the hydraulic metering device 76 regulates relative displacement between the inner and outer tubular structures 72, 74 may be varied in response to indications received from the sensor 96 of alterations in parameters of the erosive flow 12. Other manners of varying the regulation of relative displacement between the inner and outer tubular structures 72, 74 may be used in keeping with the principles of the invention.

Figure 6:
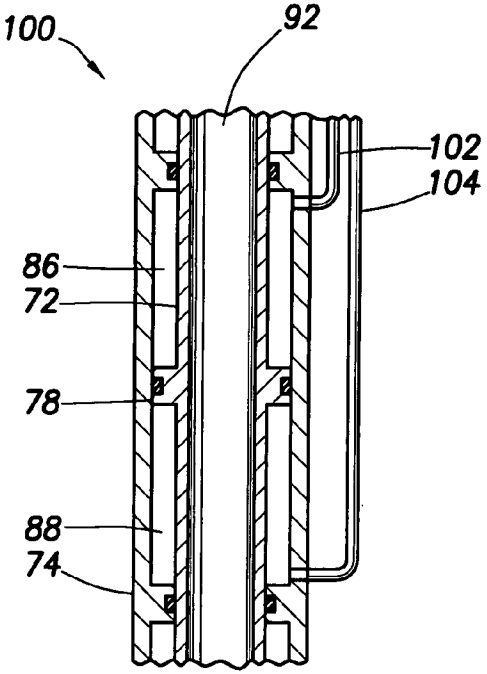
FIG. 6 is a schematic cross-sectional view of a third displacement device usable in the system of FIG. 1 and embodying principles of the invention.

Referring additionally now to FIG. 6, another displacement device 100 is representatively illustrated. The device 100 is similar in some respects to the device 70 described above, and so elements of the device 100 which are similar to those described above are indicated in FIG. 6 using the same reference numbers.

The device 100 differs in one substantial respect from the device 70 in that fluid does not flow from one of the chambers 86, 88 to the other in the device 100. Instead, lines 102, 104 are used to apply a pressure differential across the piston 78 to cause relative displacement between the inner and outer tubular structures 72, 74.

Pressure in the lines 102, 104 may be controlled from a remote location (such as the surface or a remote location in the well). For example, the lines 102, 104 could extend to a pump at the surface.

Any type of fluid (liquid, gas or a combination thereof) may be used in the lines 102, 104. It is not necessary for both or either of the lines 102, 104 to be used, since a pressure differential may be created across the piston 78 by exposing the chambers 86, 88 to pressure in the annulus 40, pressure in the passage 92, other pressures, etc. The lines 102, 104, or either of them, may extend internal or external to the device 100, or they may be formed in a sidewall of the device.

Figure 7:
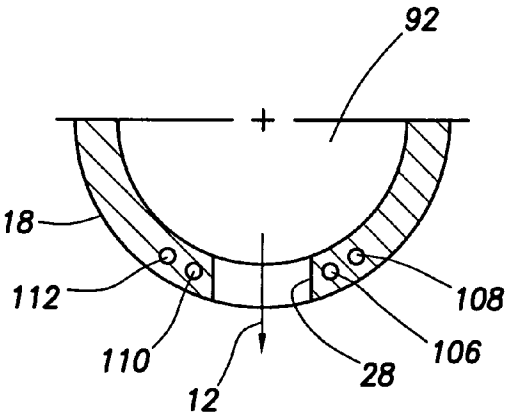
FIG. 7 is a schematic cross-sectional view of an alternate configuration usable with the device of FIG. 6.

Referring additionally now to FIG. 7, a cross-sectional view of the crossover tool 18 is representatively illustrated. In this view it may be seen that a series of passages 106, 108, 110, 112 are formed longitudinally through a sidewall of the crossover tool 18.

The displacement device 100 may be controlled, at least in part, by alteration of pressure in one or more of the passages 106, 108, 110, 112. For example, the exit port 28 may erode as the flow 12 passes through the port, so that eventually the passage 106 is placed in fluid communication with the flow.

This will cause an alteration of pressure in the passage 106. If the passage 106 is also in fluid communication with one of the lines 102, 104, then this alteration of pressure may be used to apply a differential pressure across the piston 78 and thereby cause relative displacement between the inner and outer tubular structures 72, 74.

Thus, the displacement device 100 (or another displacement device) can be actuated in response to a predetermined amount of erosion of a structure, such as the crossover tool 18. Erosion of other structures, such as the tubular structure 30 external to the ports 28, may similarly be used to indicate when the displacement device 100 (or another displacement device) should be actuated to displace the ports.

Different amounts of erosion may also be used to cause corresponding different displacements of the ports 28 by the displacement device 100. For example, erosion of the crossover tool 18 which places the passage 106 in fluid communication with the flow 12 may be used to cause an initial displacement, and further erosion of the crossover tool which places the passage 108 in fluid communication with the flow may be used to cause an additional displacement.

This may be accomplished by placing the passage 106 in fluid communication with one of the lines 102, 104 of one displacement device 100, and placing the passage 108 in fluid communication with one of the lines of another displacement device. Alternatively, a single displacement device could be configured to actuate in stages, so that when the passage 106 is placed in communication with the flow 12 the displacement device displaces the ports 28 an initial amount, and when the passage 108 is placed in communication with the flow the displacement device displaces the ports an additional amount.

The passages 110, 112 may be used to provide indications of the amount of erosion of the crossover tool 18. For example, the passages 110, 112 may be in communication with lines extending to a remote location, such as the surface or a remote location in the well.

When the passage 110 is placed in communication with the flow 12 due to an initial predetermined amount of erosion of the crossover tool 18, an alteration of pressure in the passage will occur. This alteration of pressure may be sensed at the remote location as an indication of the amount of erosion of the crossover tool 18. In response to this indication, a displacement device (such as the displacement device 100 or another displacement device) may be actuated to displace the ports 28.

Similarly, when the passage 112 is placed in communication with the flow 12 an alteration of pressure in the passage may be sensed at the remote location as an indication of a further predetermined amount of erosion of the crossover tool 18. In response to this indication, the displacement device (or an additional displacement device) may be actuated to further displace the ports 28.

Note that, although the passages 106, 108, 110, 112 are depicted as being incorporated into the crossover tool 18, any or all of them may be incorporated into any other structures in the well, such as the tubular structure 30. In addition, it is not necessary for the passages 106, 108, 110, 112 to be formed in a sidewall of a structure, since they could instead be internal or external to the structure. Any number of passages may be used as desired.

Figure 8:
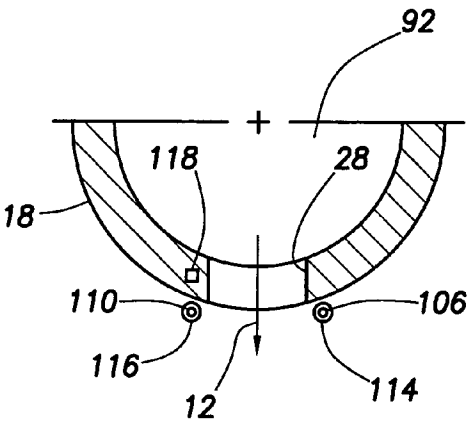
FIG. 8 is a schematic cross-sectional view of a further alternate configuration usable with the device of FIG. 6.

In FIG. 8, the passages 106, 110 are formed in lines 114, 116 positioned external to the crossover tool 18. Erosion of the line 114 will place the passage 106 in fluid communication with the flow 12 (for example, to cause actuation of a displacement device), and erosion of the line 116 will place the passage 110 in fluid communication with the flow (for example, to provide an indication of the erosion to a remote location).

Alternatively, or in addition, a sensor 118 or multiple sensors may be installed in a sidewall of the crossover tool 18 (or another structure in the well) to sense the progress of the erosion. The sensor 118 could be connected to a displacement device to cause displacement of the ports 28 when certain amounts of erosion have occurred and/or the sensor could provide indications of the erosion to a remote location.

Figure 9:
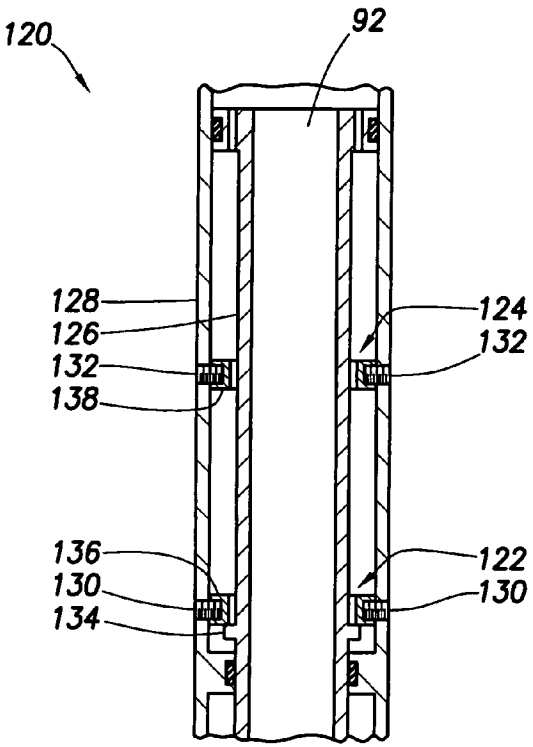
FIG. 9 is a schematic cross-sectional view of a fourth displacement device usable in the system of FIG. 1 and embodying principles of the invention.

Referring additionally to FIG. 9, another displacement device 120 is representatively illustrated. The displacement device 120 operates in response to a tensile or compressive load in the tubular string 14 to respectively elongate or compress the tubular string and cause displacement of the ports 28.

The displacement device 120 includes a series of releasing devices 122, 124 which release an inner tubular structure 126 and an outer tubular structure 128 for relative displacement therebetween when a predetermined load has been applied. For example, when it is desired to release the inner and outer tubular structures 126, 128 for an initial relative displacement, a first predetermined load may be applied to shear one or more shear screws 130 of the releasing device 122 due to the load being transferred between a shoulder 134 on the inner tubular structure and a ring 136 secured to the outer tubular structure by the shear screws.

When it is desired to release the inner and outer tubular structures 126, 128 for an additional relative displacement, a second predetermined load (preferably greater than the first predetermined load) may be applied to shear one or more shear screws 132 of the releasing device 124. In this subsequent displacement, the load is transferred from the shoulder to another ring 138 secured to the outer tubular structure 128 by the shear screws 132.

The displacement device 120 is depicted in FIG. 9 as if a compressive load is used for the first and second predetermined loads, but it will be readily appreciated that the device could easily be configured so that a tensile load is used for the first and second predetermined loads. A hydraulic metering device, such as the device 76 described above, could be used to regulate the rate of relative displacement between the inner and outer tubular structures 126, 128 after each of the releasing devices 122, 124 releases.

Although two releasing devices 122, 124 are shown in FIG. 9, any number of releasing devices could be used to produce a corresponding number of discreet relative displacements between the inner and outer tubular structures 126, 128. In addition, any other type of releasing devices (such as collets engaged in profiles, spring-biased devices, etc.) may be used in place of the devices 122, 124. The releasing devices may be used to release the inner and outer tubular structures 126, 128 for rotational and/or longitudinal relative displacement.

Figure 10:
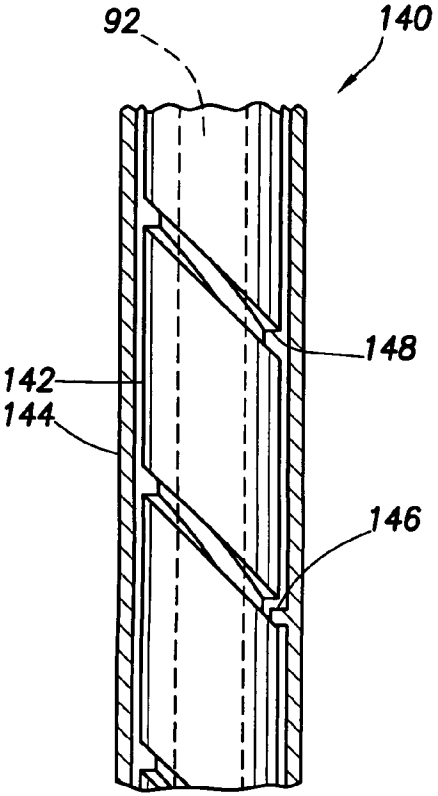
FIG. 10 is a schematic cross-sectional view of a fifth displacement device usable in the system of FIG. 1 and embodying principles of the invention.

Referring additionally to FIG. 10, another displacement device 140 is representatively illustrated. A compressive or tensile load applied to the device 140 produces a helical relative displacement between inner and outer tubular structures 142, 144.

The outer tubular structure 144 has a lug or dog 146 extending inwardly into engagement with a helical profile 148 formed on the inner tubular structure 142. Thus, as the tubular string 14 is elongated or compressed due to relative longitudinal displacement between the inner and outer tubular structures 142, 144, the engagement between the lug 146 and profile 148 also causes relative rotational displacement between the inner and outer tubular structures.

Releasing devices (such as shear members, collets, spring-biased devices, etc.) may be included in the displacement device 140 so that a predetermined compressive or tensile load must be applied to initiate relative displacement between the inner and outer tubular structures 142, 144. A hydraulic metering device may be used to regulate the relative displacement between the inner and outer tubular structures 142, 144.

Figure 11:
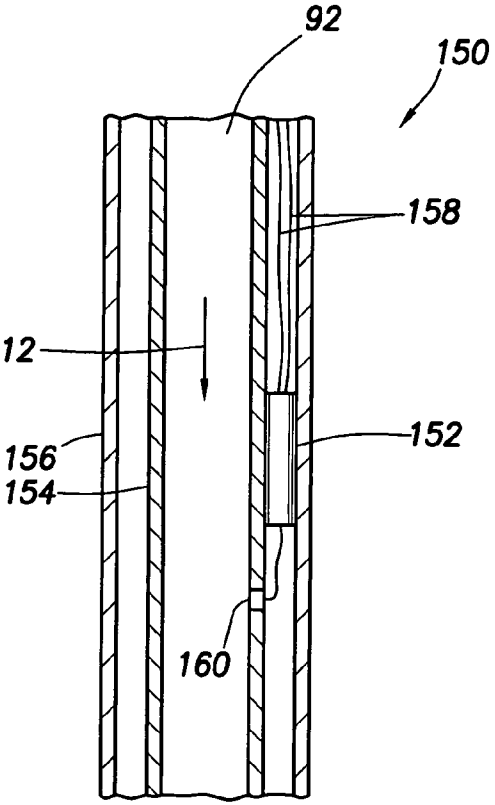
FIG. 11 is a schematic cross-sectional view of a sixth displacement device usable in the system of FIG. 1 and embodying principles of the invention.

Referring additionally now to FIG. 11, another displacement device 150 is representatively illustrated. The displacement device 150 includes an actuator comprising an electric motor 152 for causing longitudinal and/or rotational displacement between an inner tubular structure 154 and an outer tubular structure 156.

Lines 158 are connected to the motor 152 and extend to a remote location for providing electrical power to the motor and/or for remotely controlling actuation (including speed, direction, etc.) of the motor. Alternatively, the motor 152 could be provided with power from a source proximate the motor, such as a battery or other downhole power source, and actuation of the motor could be controlled using various methods.

One alternative for controlling actuation of the motor 152 is to use a sensor 160 to detect one or more parameters (such as pressure, density, flow rate, tensile and/or compressive load, etc.) downhole. Multiple sensors could be used to sense multiple parameters if desired.

The motor 152 could be actuated in response to a predetermined level or pattern of alteration of the parameter as sensed by the sensor 160. For example, a predetermined pressure pulse pattern or pressure level could be used to cause initial actuation of the motor 152, and alterations of density in the flow 12 could be used to regulate a speed of the motor.

As depicted in FIG. 11, the sensor 160 is positioned to sense a parameter of the flow 12 in the passage 92, but the sensor could be otherwise positioned in keeping with the principles of the invention. For example, the sensor 160 could be positioned to sense a parameter in the annulus 40, or to sense a tensile or compressive load transmitted through the inner or outer tubular structure 154, 156, etc.

Figure 12:
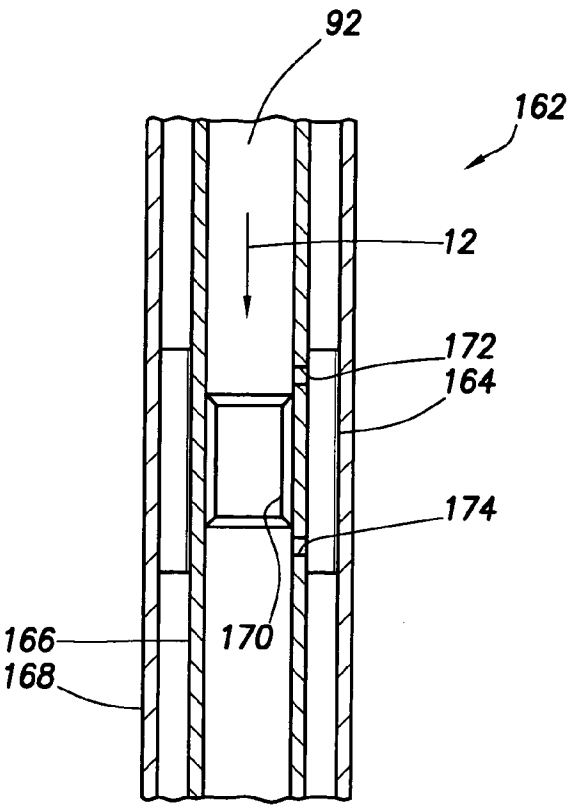
FIG. 12 is a schematic cross-sectional view of a seventh displacement device usable in the system of FIG. 1 and embodying principles of the invention.

Referring additionally now to FIG. 12, another displacement device 162 is representatively illustrated. The displacement device 162 includes an actuator comprising a hydraulic motor 164 for causing relative longitudinal and/or rotational displacement between inner and outer tubular structures 166, 168.

The hydraulic motor 164 operates in response to the flow 12 through the passage 92. As depicted in FIG. 12, a flow restriction 170 in the passage 92 causes a pressure differential between ports 172, 174 located respectively upstream and downstream of the restriction and in communication with the motor 164.

An increased pressure differential between the ports 172, 174 causes an increased rate of displacement between the inner and outer tubular structures 154, 156. However, other methods of actuating and regulating the motor (such as by use of the sensor 160 described above, etc.) may be used in keeping with the principles of the invention.

Figure 13:
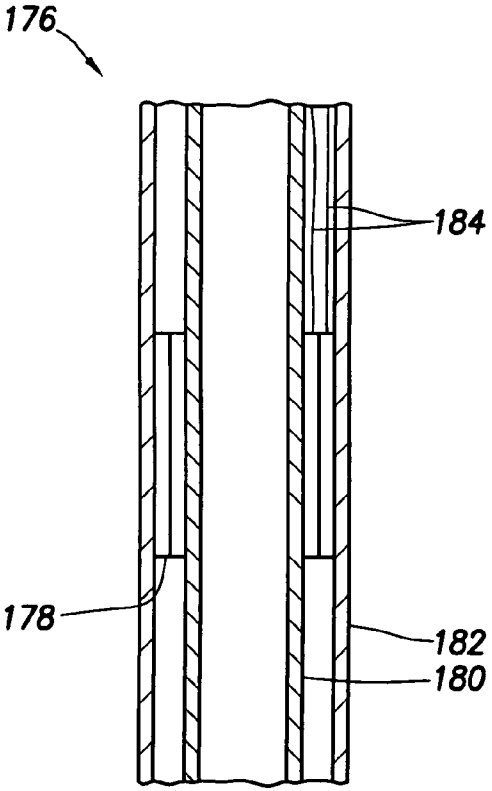
FIG. 13 is a schematic cross-sectional view of an eighth displacement device usable in the system of FIG. 1 and embodying principles of the invention.

Referring additionally to FIG. 13, another displacement device 176 is representatively illustrated. The displacement device 176 includes an electromagnetic actuator 178 for causing relative displacement between inner and outer tubular structures 180, 182.

The actuator 178 could include one or more electromagnets or permanent magnets, and/or electrostrictive or magnetostrictive devices to produce longitudinal and/or rotational displacement between the inner and outer tubular structures 180, 182. The actuator 178 may be remotely actuated and/or controlled via lines 184 extending to a remote location, or a power source (such as a battery or another downhole power source) may be located proximate the actuator, and the actuator may be controlled using one or more sensors (such as the sensor 160 described above).

Figure 14:
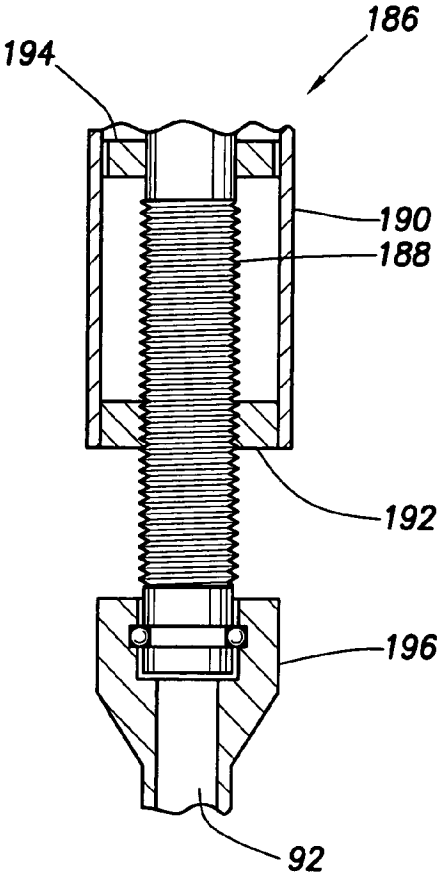
FIG. 14 is a schematic cross-sectional view of a ninth displacement device usable in the system of FIG. 1 and embodying principles of the invention.

Referring additionally now to FIG. 14, another displacement device 186 is representatively illustrated. The displacement device 186 includes an inner tubular structure 188 and an outer tubular structure 190 engaged using a threaded or ball screw-type mechanism 192.

Relative longitudinal displacement between the inner and outer tubular structures 188, 190 causes relative rotation between the tubular structures due to the mechanism 192. A friction device 194 carried on the inner tubular structure 188 contacts the outer tubular structure 190 and generates friction therebetween, thereby regulating a speed of the relative rotation and longitudinal displacement between the inner and outer tubular structures.

A swivel 196 prevents the relative rotation between the inner and outer tubular structures 188, 190 from being transmitted through the displacement device 186. However, the swivel 196 could be eliminated if it is desired to rotationally, as well as longitudinally, displace the ports 28.

Note that the displacement devices 70, 120, 140, 150, 162, 176, 186 described above may be considered to include a travel joint as that term is understood by those skilled in the art, since they may include longitudinally telescoping tubular structures interconnected in a tubular string.

Figure 15:
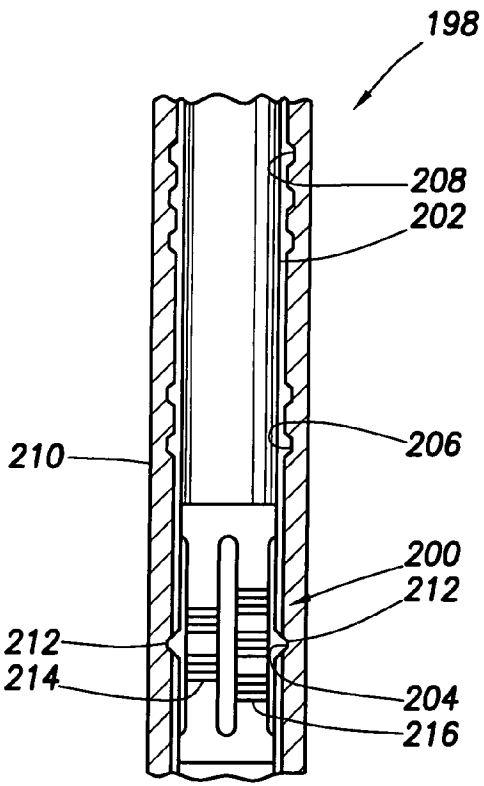
FIG. 15 is a schematic cross-sectional view of a tenth displacement device usable in the system of FIG. 1 and embodying principles of the invention.

Representatively illustrated in FIG. 15 is another displacement device 198. The displacement device 198 includes a collet assembly 200 carried on an inner tubular structure 202 for engagement with a series of profiles 204, 206, 208 formed in an outer tubular structure 210.

Engagement between the collet assembly 200 and any of the profiles 204, 206, 208 may be used to releasably secure the tubular string 14 in the well, and so the displacement device 198 may be considered a combination of an anchoring device and a displacement device. For example, the inner tubular structure 202 could be interconnected as part of the tubular string 14, the outer tubular structure 210 could be interconnected as part of the tubular assembly 26 of the system 10, in which case the displacement device 198 could be used for the anchoring device 20 of the system 10. Alternatively, the displacement device 198 could be used for the displacement device 46, 48 or 50 of the system 10, either with or without use of any other anchoring device to secure the tubular string 14 in the well.

As depicted in FIG. 15, two collets 212 of the collet assembly 200 having a single lobe on each collet are engaged with the profile 204 which has a corresponding single recess. A predetermined load is required to disengage the collets 212 from the profile 204 and permit an initial relative displacement between the inner and outer tubular structures 202, 210.

The displacement device 198 is shown in a configuration in which the inner tubular structure 202 is to be displaced upward relative to the outer tubular structure 210, but it will be readily appreciated that the displacement device could easily be configured to provide for downward displacement, rotational displacement, etc., if desired.

The inner tubular structure 202 displaces upward relative to the outer tubular structure 210 until collets 214 (only one of which is visible in FIG. 15) having two lobes thereon engage the profile 206 having a corresponding number of recesses formed thereon. Another (preferably greater) predetermined load is required to disengage the collets 214 from the profile 206 and permit further relative displacement between the inner and outer tubular structures 202, 210.

Again, the inner tubular structure 202 displaces upward relative to the outer tubular structure 210 until collets 216 (only one of which is visible in FIG. 15) having three lobes thereon engage the profile 208 having a corresponding number of recesses formed thereon. Yet another (preferably still greater) predetermined load is required to disengage the collets 216 from the profile 208 to permit additional relative displacement between the inner and outer tubular structures 202, 210.

Thus, the erosive flow 12 may be initiated with the collets 212 engaged with the profile 204. When it is desired to displace the ports 28, an upwardly directed predetermined load may be applied to the tubular string 14 to cause the collets 212 to disengage from the profile 204, and upwardly displace the inner tubular structure 202 relative to the outer tubular structure 210, until the collets 214 engage the profile 206.

When it is desired to further upwardly displace the ports 28, a greater upwardly directed predetermined load may be applied to the tubular string 14 to cause the collets 214 to disengage from the profile 206, and upwardly displace the inner tubular structure 202 relative to the outer tubular structure 210, until the collets 216 engage the profile 208. When it is again desired to further upwardly displace the ports 28, a still greater upwardly directed predetermined load may be applied to the tubular string 14 to cause the collets 216 to disengage from the profile 208, and upwardly displace the inner tubular structure 202 relative to the outer tubular structure 210.

Thus, the differently configured collets 212, 214, 216 and correspondingly configured profiles 204, 206, 208 may be used to selectively position the inner and outer tubular structures 202, 210 relative to each other as the flow 12 passes through the ports 28. Although three sets of the collets 212, 214, 216 and profiles 204, 206, 208 have been described, it will be appreciated that any number of sets of collets and profiles may be used.

Furthermore, the collets 212, 214, 216 may be selectively engaged with the profiles 204, 206, 208 using methods other than corresponding numbers of lobes and recesses. For example, different spacings of lobes and recesses, different depths or other configurations of lobes and recesses, or any other method of selectively engaging the collets 212, 214, 216 with the profiles 204, 206, 208 may be used in keeping with the principles of the invention.

Although different numbers of lobes engaging corresponding numbers of recesses is used in the displacement device 198 to alter the predetermined loads required to disengage the collets 212, 214, 216 from the respective profiles 204, 206, 208, it is not necessary for the loads to be altered, and other means may be used to alter the loads. For example, the predetermined loads could all be the same by configuring the collets 212, 214, 216 and profiles 204, 206, 208 the same, and the predetermined loads could be altered by changing the resilience or elasticity of the collets, etc.

Figure 16:
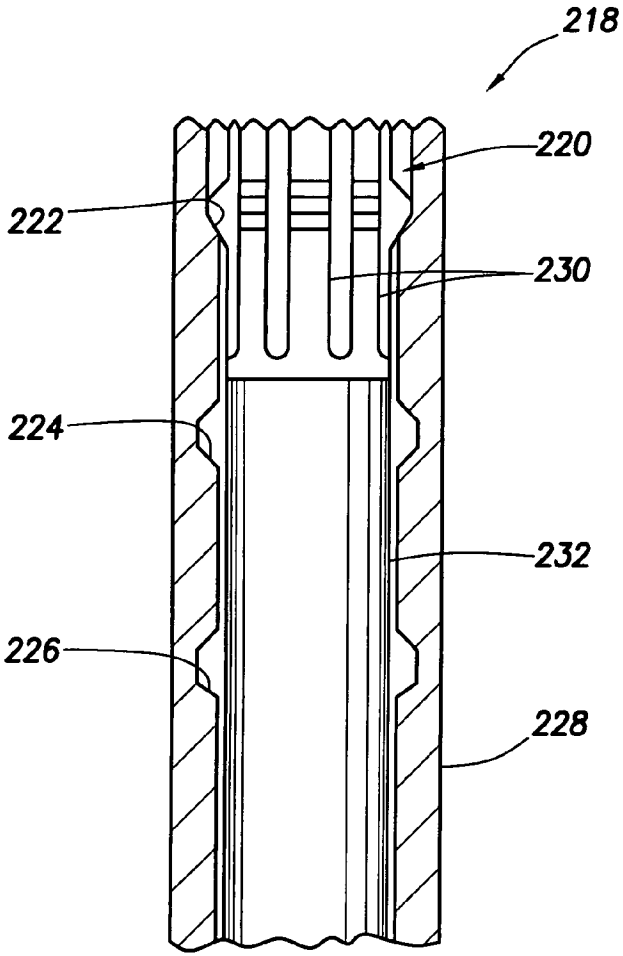
FIG. 16 is a schematic cross-sectional view of an eleventh displacement device usable in the system of FIG. 1 and embodying principles of the invention.

Referring additionally now to FIG. 16, another displacement device 218 is representatively illustrated. The displacement device 218 includes a collet assembly 220 carried on an inner tubular structure 232 for engagement with a series of profiles 222, 224, 226 formed in an outer tubular structure 228.

Engagement between the collet assembly 220 and each of the profiles 222, 224, 226 may be used to releasably secure the tubular string 14 in the well as described above for the displacement device 198. Thus, the displacement device 218 may be considered as incorporating an anchoring device therein, as well.

The collet assembly 220 includes one or more collets 230. Instead of only selected ones of the collets 230 engaging corresponding ones of the profiles 222, 224, 226 (as in the displacement device 198), all of the collets are used to engage each of the profiles. As depicted in FIG. 16, all of the collets 230 are engaged with the upper profile 222.

A predetermined load may be applied to disengage the collets 230 from the profile 222 and downwardly displace the inner tubular structure 232 relative to the outer tubular structure 228. The collets 230 will then engage the profile 224.

Note that the profile 222 has a steeper (more upwardly inclined) upwardly facing shoulder formed thereon than does the profile 224. This means that a greater predetermined load will be required to disengage the collets 230 from the profile 224 and further downwardly displace the inner tubular structure 232 relative to the outer tubular structure 228, so that the collets will then engage the profile 226.

Similarly, the profile 224 has a steeper upwardly facing shoulder formed thereon than does the profile 226. Therefore, a still greater predetermined load is required to disengage the collets 230 from the profile 226 and further downwardly displace the inner tubular structure 232 relative to the outer tubular structure 228.

Any number of profiles may be used to provide any corresponding number of discreet relative longitudinal positions of the inner an outer tubular structures 232, 228. Although the displacement device 218 is configured for successively increased loads to downwardly displace the inner tubular structure 232 relative to the outer tubular structure 228, it will be readily appreciated that it is not necessary for the loads to increase (the profiles 222, 224, 226 could be configured so that the loads remain constant or decrease), and it is not necessary for the inner tubular structure to displace downwardly relative to the outer tubular structure (the inner tubular structure could displace upwardly and/or rotationally relative to the outer tubular structure).

Figure 17:
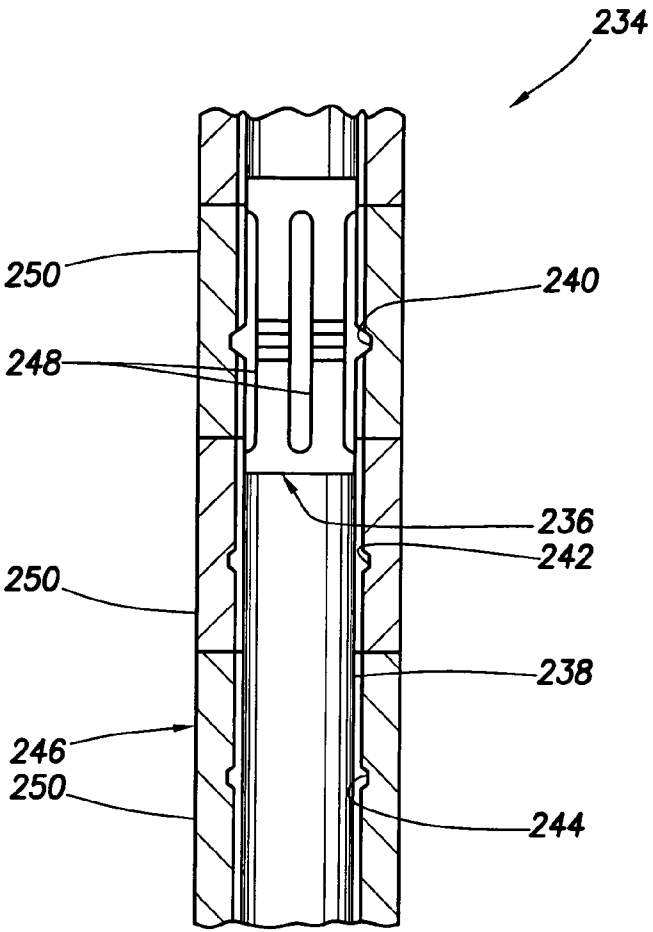
FIG. 17 is a schematic cross-sectional view of a twelfth displacement device usable in the system of FIG. 1 and embodying principles of the invention.

Referring additionally now to FIG. 17, another displacement device 234 is representatively illustrated. As with the displacement devices 198, 218 described above, the displacement device 234 includes a collet assembly 236 carried on an inner tubular structure 238 for engagement with a series of profiles 240, 242, 244 formed in an outer tubular structure 246.

The collet assembly 236 includes one or more collets 248, each of which is configured to engage each of the profiles 240, 242, 244. The profiles 240, 242, 244 are configured similar to one another and so, unlike the displacement devices 198, 218 described above, the same load is used to disengage the collets 248 from each of the profiles.

Thus, the erosive flow 12 may be initiated with the collets 248 engaged with the profile 240 as depicted in FIG. 17. When it is desired to displace the ports 28, a downwardly directed predetermined load may be applied to the tubular string 14 to cause the collets 248 to disengage from the profile 240, and downwardly displace the inner tubular structure 238 relative to the outer tubular structure 246, until the collets 248 engage the profile 242.

When it is desired to further downwardly displace the ports 28, the same downwardly directed predetermined load may be applied to the tubular string 14 to cause the collets 248 to disengage from the profile 242, and downwardly displace the inner tubular structure 238 relative to the outer tubular structure 246, until the collets engage the profile 244. When it is again desired to further downwardly displace the ports 28, the same downwardly directed predetermined load may be applied to the tubular string 14 to cause the collets 248 to disengage from the profile 244, and downwardly displace the inner tubular structure 238 relative to the outer tubular structure 246.

Thus, the collets 248 and profiles 240, 242, 244 may be used to selectively position the inner and outer tubular structures 238, 246 relative to each other as the flow 12 passes through the ports 28. Although three profiles 240, 242, 244 have been described, it will be appreciated that any number of profiles may be used. In addition, although the profiles 240, 242, 244 are depicted in FIG. 17 as being formed in separate sections 250 (known to those skilled in the art as indicator collars) of the outer tubular structure 246, it will be appreciated that the profiles could be formed in a single member, or in any number of members.

Figure 18:
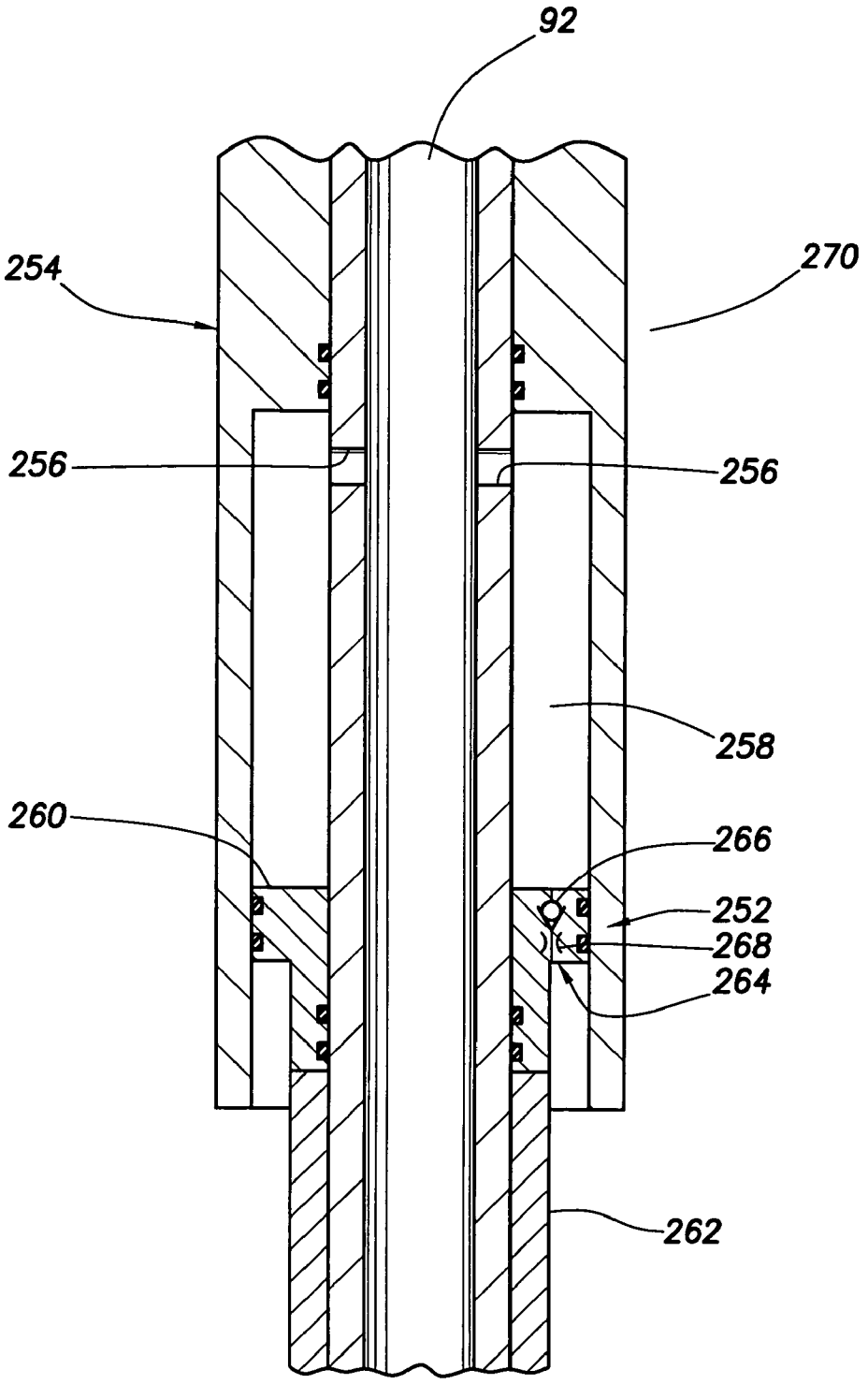
FIG. 18 is a schematic cross-sectional view of a thirteenth displacement device usable in the system of FIG. 1 and embodying principles of the invention.

Referring additionally to FIG. 18, another displacement device 252 is representatively illustrated. The displacement device 252 is included as a part of a service tool 254 which may be used for the service tool 16 in the system 10 shown in FIG. 1.

One of the functions performed by the service tool 254 is to facilitate setting a packer, such as the packer 58 in the system 10. To set the packer 58, pressure is applied to the passage 92 after blocking the passage below a set of ports 256, for example, using a ball or other plug (not shown) dropped through the passage.

The ports 256 provide fluid communication between the passage 92 and an annular chamber 258 in which an annular piston 260 is sealingly and reciprocably received. The pressure applied to the passage 92 forces the piston 260 to displace downwardly to the position depicted in FIG. 18.

When the piston 260 is biased downwardly by the pressure applied to the chamber 258, the piston contacts a sleeve 262 and biases it downwardly, which causes the packer 58 to set. This is similar to the manner in which a service tool known as the Multi-Position Tool™ is used to set a packer known as a Versa-Trieve™ Packer, and is well understood by those skilled in the art. The Multi-Position Tool™ and Versa-Trieve Packer™ are available from Halliburton Energy Services, Inc. of Houston, Tex.

However, the service tool 254 includes in the displacement device 252 a hydraulic metering device 264 which permits the service tool to displace downwardly relative to the packer 58 after the packer has been set and the pressure applied to the passage has been removed. The hydraulic metering device 264 includes a check valve 266 and a flow restrictor 268.

The check valve 266 prevents fluid from flowing from the chamber 258 through the device 264 to the annulus 270 external to the service tool 254 while the pressure is being applied to the passage 92 to set the packer 58. At this point, pressure in the chamber 258 is greater than pressure in the annulus 270.

However, when the pressure applied to the passage 92 is removed, pressure in the chamber 258 will be less than pressure in the annulus 270 and the check valve 266 will allow fluid to flow from the annulus into the chamber. A downwardly directed compressive load on the service tool 254 (e.g., applied by slacking off on the tubular string 14 at the surface) will tend to bias the piston 260 upwardly in the chamber 258, since the sleeve 262 bears against the packer 58, which is anchored in the well at this point.

The restrictor 268 will regulate the flow of this fluid so that, as the erosive flow 12 is pumped through the passage 92 and out of the ports 28, the service tool 254 will slowly displace downwardly relative to the packer 58. This will displace the ports 28 as the erosive flow 12 is passing through the ports.

Although the above descriptions of various embodiments of displacement devices have focused on displacing the ports 28 in order to displace the impingement locations 32 in the tubular structure 30, it will be readily appreciated that displacement devices may also be used to displace the ports 34, for example, to displace corresponding impingement locations in the casing or other tubular structure 44 external to the assembly 26. Thus, the invention is not limited to displacing any particular exit ports, but rather is directed to the problem of reducing the detrimental effects of an erosive flow by displacing a location of impingement due to such flow.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A system for delivering an erosive flow into a subterranean well, the system comprising:

a port displacing in the well while the erosive flow passes through the port; and a displacement device which displaces the port in the well while the erosive flow passes through the port, the displacement device being interconnected in a tubular string between the port and an anchoring device securing the tubular string in the well.

2. The system of claim 1, wherein the port is formed in a sidewall of the tubular string.

3. The system of claim 1, wherein the port is an exit port for delivering the erosive flow into the well external to the port.

4. The system of claim 1, wherein the displacement device includes a ratchet mechanism for displacing the port.

5. The system of claim 1, wherein the displacement device includes a hydraulic metering device.

6. The system of claim 1, wherein the displacement device displaces the port in response to compression in the tubular string.

7. The system of claim 1, wherein the displacement device displaces the port in response to tension in the tubular string.

8. The system of claim 1, wherein the displacement device includes a piston which displaces the port in response to a pressure differential across the piston.

9. The system of claim 1, wherein the displacement device displaces the port in response to alteration of pressure in the device.

10. The system of claim 1, wherein the displacement device displaces the port in response to alteration of a parameter of the erosive flow.

11. The system of claim 1, wherein the displacement device displaces the port in response to erosion of a structure in the well.

12. The system of claim 1, wherein the displacement device includes a series of release devices, each release device releasing to permit displacement of the port when a predetermined force is applied to the release device.

13. The system of claim 1, wherein the displacement device includes a helical structure for helically displacing the port.

14. The system of claim 1, wherein the displacement device includes an electric motor.

15. The system of claim 1, wherein the displacement device includes a hydraulic motor.

16. The system of claim 1, wherein the displacement device includes an electromagnetic actuator.

17. The system of claim 1, wherein the displacement device produces relative displacement between the tubular string and the anchoring device.

18. The system of claim 17, wherein the displacement device includes a hydraulic metering device for regulating displacement of the tubular string relative to the anchoring device.

19. The system of claim 18, wherein the hydraulic metering device is included in a service tool interconnected in the tubular string.

20. The system of claim 1, wherein the anchoring device includes at least one collet securing the tubular string within an outer tubular assembly.

21. The system of claim 1, wherein the anchoring device secures the tubular string to a wellbore of the well.

22. The system of claim 1, wherein the anchoring device comprises engagement between a service tool and a packer assembly in the well.

23. The system of claim 1, further comprising a swivel interconnected in the tubular string, the port being positioned between the swivel and the anchoring device.

24. The system of claim 1, wherein the port displaces longitudinally in the well while the erosive flow passes through the port.

25. The system of claim 1, wherein the port displaces rotationally in the well while the erosive flow passes through the port.

26. The system of claim 1, wherein the port displaces both rotationally and longitudinally in the well while the erosive flow passes through the port.

27. The system of claim 1, wherein the erosive flow passes from the port to an annulus in the well external to a screen.

28. The system of claim 1, wherein the port is positioned within a tubular structure in the well, and wherein displacement of the port displaces an erosive impingement of the erosive flow on the tubular structure.

29. A system for delivering an erosive flow into a subterranean well, the system comprising:

a displacement device which displaces a port in the well while the erosive flow passes through the port, the erosive flow comprising at least one of a proppant and gravel, wherein the displacement device displaces the port in response to compression in a tubular string.

30. The system of claim 29, wherein the tubular string is compressed at a location between the port and an anchoring device securing the tubular string in the well.

31. The system of claim 29, wherein the tubular string is compressed at a travel joint positioned between the port and an anchoring device securing the tubular string in the well.

32. A system for delivering an erosive flow into a subterranean well, the system comprising:

a displacement device which displaces a port in the well while the erosive flow passes through the port, the erosive flow comprising at least one of a proppant and gravel, wherein the displacement device displaces the port in response to tension in a tubular string, and wherein the tubular string is elongated at a location between the port and an anchoring device securing the tubular string in the well.

33. A system for delivering an erosive flow into a subterranean well, the system comprising:

a displacement device which displaces a port in the well while the erosive flow passes through the port, the erosive flow comprising at least one of a proppant and gravel, wherein the displacement device displaces the port in response to tension in a tubular string, and wherein the tubular string is elongated at a travel joint positioned between the port and an anchoring device securing the tubular string in the well.

34. A system for delivering an erosive flow into a subterranean well, the system comprising:

a displacement device which displaces a port in the well while the erosive flow passes through the port, the erosive flow comprising at least one of a proppant and gravel, wherein the displacement device produces relative displacement between a tubular string and an anchoring device securing the tubular string in the well.

35. The system of claim 34, wherein the displacement device includes a hydraulic metering device for regulating displacement of the tubular string relative to the anchoring device.

36. The system of claim 35, wherein the hydraulic metering device is included in a service tool interconnected in the tubular string.

37. A system for delivering an erosive flow into a subterranean well, the system comprising:

a displacement device which displaces a port in the well while the erosive flow passes through the port, and wherein the displacement device is interconnected in a tubular string between the port and an anchoring device securing the tubular string in the well.

38. The system of claim 37, wherein the anchoring device includes at least one collet securing the tubular string within an outer tubular assembly.

39. The system of claim 38, wherein the collet engages a spaced apart series of profiles.

40. The system of claim 39, wherein there are multiple collets, and wherein an increased number of the collets engage each profile in succession.

41. The system of claim 39, wherein each profile in succession is configured to increase a force required to release the collet from the profile as compared to a force required to release the collet from a prior profile.

42. The system of claim 41, wherein each profile in succession has a more steeply inclined shoulder thereon as compared to a shoulder on a prior profile.

43. The system of claim 37, wherein the anchoring device secures the tubular string to a wellbore of the well.

44. The system of claim 37, wherein the anchoring device comprises engagement between a service tool and a packer assembly in the well.

45. The system of claim 37, further comprising a swivel interconnected in the tubular string, the port being positioned between the swivel and the anchoring device.

46. A method of delivering an erosive flow into a subterranean well, the method comprising the steps of:

passing the erosive flow through a port in the well;

displacing the port while the erosive flow passes through the port, and while the erosive flow passes to an exterior of a well screen in the well, thereby delivering a particulate slurry to the exterior of the well screen, wherein the displacing step further comprises compressing a tubular string to displace the port, and wherein the passing and displacing steps are performed without expanding any tubular structure through which the erosive flow passes.

47. A method of delivering an erosive flow into a subterranean well, the method comprising the steps of:

passing the erosive flow through a port in the well;

displacing the port while the erosive flow passes through the port, and while the erosive flow passes to an exterior of a well screen in the well, thereby delivering a particulate slurry to the exterior of the well screen, wherein the displacing step further comprises elongating a tubular string to displace the port, and wherein the passing and displacing steps are performed without expanding any tubular structure through which the erosive flow passes.

48. A method of delivering an erosive flow into a subterranean well, the method comprising the steps of:

passing the erosive flow through a port in the well;

displacing the port while the erosive flow passes through the port, and while the erosive flow passes to an exterior of a well screen in the well, thereby delivering a particulate slurry to the exterior of the well screen, wherein the displacing step further comprises actuating a displacement device interconnected in a tubular string between the port and an anchoring device, and wherein the passing and displacing steps are performed without expanding any tubular structure through which the erosive flow passes; and securing the tubular string in the well utilizing the anchoring device.

49. The method of claim 48, wherein the securing step further comprises securing the tubular string within an outer tubular assembly utilizing a locking mechanism of the anchoring device.

50. The method of claim 48, wherein the securing step further comprises securing the tubular string to a wellbore of the well.

51. The method of claim 48, wherein the securing step further comprises engaging a service tool with a packer assembly in the well.

52. The method of claim 48, further comprising the step of interconnecting a swivel in the tubular string, the port being positioned between the swivel and the anchoring device.

* * * * *